United States Patent [19]

Paton et al.

[11] 4,120,695

[45] Oct. 17, 1978

[54] PROCESS OF THE ELECTROSLAG REMELTING OF CONSUMABLE ELECTRODES

[76] Inventors: Boris Evgenievich Paton, ulitsa Kotsjubinskogo, 9, kv. 21; Boris Izrailevich Medovar, bulvar Lesi Ukrainki, 2, kv. 8; Leonid Mikhailovich Stupak, Brest-Litovsky prospekt, 39, kv. 9; Viktor Mikhailovich Baglai, ulitsa Semashko, 10, kv. 54; Alexei Georgievich Bogachenko, ulitsa Miljutenko, 15/2, kv. 141, all of Kiev; Sergei Sergeevich Kazakov, N-Dnepropetrovskaya ulitsa, 14a, kv. 39, Zaporozhie; Anatoly Konstantinovich Tsykulenko, ulitsa Babushkina, 23, kv. 38, Kiev, all of U.S.S.R.

[21] Appl. No.: 768,741

[22] Filed: Feb. 15, 1977

Related U.S. Application Data

[63] Continuation of Ser. No. 551,409, Feb. 20, 1975, abandoned, which is a continuation of Ser. No. 474,145, May 28, 1974, abandoned, which is a continuation of Ser. No. 251,736, May 9, 1972, abandoned.

[51] Int. Cl.[2] ..... C22D 7/00

[52] U.S. Cl. ..... 75/10 C; 164/52

[58] Field of Search ..... 75/10 C, 10 R; 164/52

[56] References Cited

U.S. PATENT DOCUMENTS 3,776,294 12/1973 Paton et al. ..... 75/10 B

*Primary Examiner*—M. J. Andrews

*Attorney, Agent, or Firm*—Holman & Stern

[57] ABSTRACT

A process of simultaneous electroslag remelting several consumable electrodes fastened in a common electrode holder which contemplates feeding a flow of cooled gas to a lateral face of the electrode immersed inadequately in a slag bath, i.e. fused off to a larger degree.

3 Claims, 1 Drawing Figure

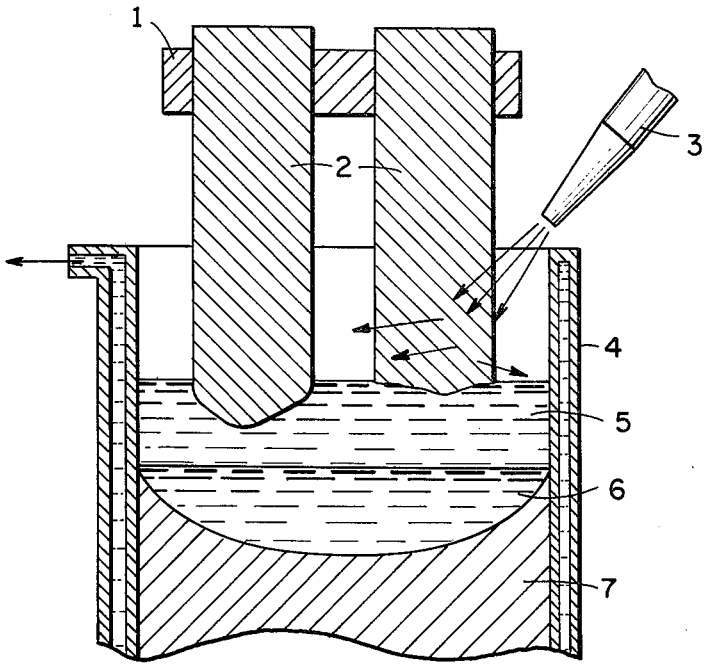
1
2
3
4
5
6
7

PROCESS OF THE ELECTROSLAG REMELTING OF CONSUMABLE ELECTRODES

This is a continuation of application Ser. No. 551,409, filed Feb. 20, 1975 which in turn is a R. 60 continuation of U.S. Ser. No. 474,145, filed May 28, 1974, which in turn is a R. 60 continuation of U.S. Ser. No. 251,736 filed May 9, 1972, all now abandoned.

BACKGROUND OF THE INVENTION

1. Field of the Invention

The present invention relates to electrometallurgy and more particularly to processes for the electroslag remelting of consumable electrodes, for instance two consumable electrodes at a time.

2. Description of Prior Art

Commonly known is a process of electroslag remelting several consumable electrodes simultaneously in a cooled mold, the process being associated with the formation of a slag and metal baths, the consumable electrodes in said process being connected to unlike poles of a power source and secured expediently in a common electrode holder.

The simultaneous melting of several consumable electrodes is best suited for melting ingots of large cross-sections, e.g. 1200×400 mm.

However, the consumable electrodes produced by casting, rolling or forging are not uniform in terms of their cross-sectional areas although within production tolerances. Moreover, the consumable electrodes are slightly curved along their length thereby resulting in their being mounted at a distance from the mold walls. Besides, during melting, the consumable electrodes are not uniformly heated throughout their length and over their cross-sections by electrical currents flowing through them; also, the electrodes are not uniformly cooled by natural gases that may be liberated by the electrodes.

As a result, as shown by investigations, the depth of immersion of the consumable electrodes melted at one and the same time changes nonuniformly and the resulting discrepancy (unbalance) adversely affects the quality of the ingots being handled.

Naturally, the portion of the electrode melting adjacent the surface of the slag bath is subjected to heavy oxidation and contaminates the metal being remelted. The portion of the electrode immersed to a greater depth exerts on the other hand a negative influence on the formation of the ingot surface.

It may also happen that the major (larger) fraction of electrical current flowing through the electrodes will pass not through the ingot being deposited but through the slag between the electrodes.

The phenomenon is also observed in electroslag remelting with equalizing currents flowing through the ingot when different currents pass through the consumable electrodes.

OBJECTS AND SUMMARY OF THE INVENTION

The present invention has the principal object to provide a process for the electroslag remelting of consumable electrodes secured in a common electrode holder which ensures an equal depth of immersion of the electrodes in a slag bath during their melting.

Another important object of this invention is the enhancement of the quality of the ingots produced.

Still another object of the present invention is the possibility of controlling (decelerating or accelerating) the melting of the consumable electrodes and hence using the consumable electrodes of nonuniform cross-sections, including those with appropriate tolerances and curvature, irrespective of the fact that the electrodes are heated by electrical current and displaced as a result in relation to mold walls.

The above objects are achieved by providing a process of electroslag remelting consumable electrodes, at least two electrodes at a time, secured in a common electrode holder and remelted in a cooled mold with the formation of slag and metal baths, wherein conforming to this invention, in a zone adjacent to the slag bath, a flow of cooled gas is fed to a lateral face of the consumable electrode immersed inadequately in the slag bath.

The stream of the cooled gas decreases the temperature of both the electrode to whose surface it is fed and of the molten slag in that zone.

This results in a reduction in a melting rate of the electrode which in consequence lowers deeper in the slag reducing thereby the unbalance of the electrodes.

It would be sound practice to direct the flow of the cooled gas from the electrode immersed to a lesser depth to that submerged deeper.

This would promote equalizing the depths of immersion of the consumable electrodes by slowing down the melting rate of the electrode immersed to a lesser depth in the slag and increasing that of the electrode submerged deeper.

It is also desirable to introduce particles of hard materials which are refining reagents into the stream of the cooled gas.

This will render possible a more intense cooling of the electrodes immersed inadequately in the slag bath, enhancing meanwhile the quality of the ingots being melted.

BRIEF DESCRIPTION OF THE DRAWING

The nature of the present invention will become more fully apparent from a consideration of the description of an exemplary embodiment with reference to the accompanying drawing wherein:

The FIGURE shows a device for simultaneously electroslag remelting two consumable electrodes.

DETAILED DESCRIPTION OF PREFERRED EMBODIMENT

Accommodated in a common electrode holder 1 are two consumable electrodes 2 having dissimilar cross-sectional areas and connected to different ends of a winding of a single-phase transformer.

An electrode holder is a device for holding one or several consumable electrodes. One example of an electrode holder is disclosed in U.S. Pat. No. 3,379,238 and component 68 in FIG. 2 in particular. The electrodes may be fixed in the electrode holder by appropriate known means, such as by lateral pressure, wedging under gravity and the like. It is only important in the present invention that the electrodes fixed in the common electrode holder cannot be displaced relative to each other during the melting. The electrodes are fed into the slag bath together with the holder without any possibility of relative movement.

A pool of molten slag 5 is established in a cooled mold 4 by using any suitable process and the ends of consumable electrodes are immersed to an equal depth into the pool or bath with the transformer cut-out.

When the transformer is cut-in, electrical current begins to flow between the electrodes, heats the slag, and the electrodes start melting off. As the consumable electrodes 2 melt off, molten metal is collected in the mold 4 forming a metal bath 6, the molten metal gradually solidifying into an ingot 7.

As the electrodes are melted down, they are immersed deeper into the molten slag. The melting rate of the electrodes is changed by varying the current flowing through the electrodes and varying the transformer voltage. Unbalance is determined as usual with the aid of voltmeters connected across each of the electrodes and the ingot being built-up.

A rise in the voltage value across one of the electrodes and the ingot as compared with that across the other electrode and the ingot is an indication that the first electrode is immersed in the slag to a lesser depth than the other.

According to this invention, a cooling gaseous medium, for instance outdoor air, is blown from a nozzle 3 into the zone of the electrode immersed in the slag to a lesser depth until the unbalance is eliminated and just at that instant the voltage across the electrodes and the ingot is equalized.

The cooling medium reduces the temperature of the electrode to whose lateral face it is supplied decreasing thereby the temperature of the slag bath in that zone. The electrode being cooled, its melting rate decreases and hence it is immersed deeper in the slag, i.e. the unbalance (mismatching) of the currents flowing through the electrodes tends to diminish.

As to the cooling medium for cooling the electrode and the slag in the electrode zone, use may be made of argon, an argon-oxygen mixture and/or other gases depending on the chemical composition of both the electrodes and the slag.

It is possible to introduce in the gas, particles of any known refining reagents which find use in slag remelting.

A directed gas flow can be obtained in the mold by producing a pressure drop at the electrodes.

If the unbalance is caused by a constant factor such as a difference in the cross-sections along the length of the electrodes, cold gas shall be constantly blown in the zone of the electrode of a smaller cross-section following voltmeter readings.

If the voltage across the electrode of a smaller cross-section and the ingot tends to increase as compared with that across another electrode and the ingot, the amount of cooling gas blown in the zone of the first (smaller cross-section) electrode shall be increased.

If, on the contrary, the voltage is liable to decrease, the amount of the cooling gas to be blown shall be reduced.

The process proposed herein was subjected to operational trial in melting 1200×400 mm. ingots. Two 450×250 mm. consumable electrodes were remelted for that purpose. The difference in electrode cross-sections amounted to 8%. Unbalance was equal to 100–150 mm. at a voltage drop across the electrodes and a baseplate $\Delta U = 10–17$ V.

Nearly the entire surface of one of the electrodes melted on the surface of a slag bath.

By feeding cooling air in the zone of the electrode immersed to a lesser depth in the slag the melting rate of that electrode was reduced, its immersion in the molten slag increased up to 0–20 mm. and the unbalance was attained at $\Delta U = 1–2$ V. With invariable electrical parameters of the melting process and a constant ingot building-up rate, both electrodes were melted without oxidation of metal on the surface of the slag bath and, the surface quality of the ingot was very much improved along the entire perimeter.

We claim:

1. A method of electroslag remelting of consumable electrodes comprising the steps of: securing at least two electrodes having dissimilar cross sections and shapes in a common electrode holder; establishing a slag bath in a mold cavity; immersing the end surfaces of the consumable electrodes to an equal depth in the slag bath; progressively melting the consumable electrodes and forming a metal bath in the cavity of the mold under the slag bath, the consumable electrodes melting at different rates and their end surfaces becoming immersed in the slag bath at different depths; feeding a gaseous cooling medium onto the exposed surface of the consumable electrode having its end surface closer to the slag/atmosphere interface than the end surfaces of the other electrodes whereby the consumable electrode which is less immersed in relation to the other electrodes is partially cooled by the gaseous cooling medium and descends into the slag bath; and continuing to feed the gaseous cooling medium until the penetration of all of the electrodes into the slag bath becomes equal.

2. The method as claimed in claim 1 further comprising the step of introducing particles of refining reagents into the gaseous medium.

3. The method as claimed in claim 1 wherein the gaseous cooling medium is fed onto the exposed surface of the consumable electrode having its end surface closer to the slag/atmosphere interface than the end surfaces of the other electrodes to cool that electrode so that it melts at a slower rate thereby increasing its depth in the slag bath relative to the other electrodes.

* * * * *